US009394719B2

(12) United States Patent
Choi

(10) Patent No.: US 9,394,719 B2
(45) Date of Patent: Jul. 19, 2016

(54) FOLDING BAR TABLE

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., Ltd., Xiamen (CN)

( * ) Notice: Subject to any disclaimer, the term of this patent is extended or adjusted under 35 U.S.C. 154(b) by 0 days.

(21) Appl. No.: 14/689,319

(22) Filed: Apr. 17, 2015

(65) Prior Publication Data

US 2015/0296975 A1 Oct. 22, 2015

(30) Foreign Application Priority Data

Apr. 18, 2014 (CN) ..... 2014 2 0190335

(51) Int. Cl.

| | |
|---|---|
| ***A47B 37/00*** | (2006.01) |
| ***E04H 15/02*** | (2006.01) |
| ***A47B 3/083*** | (2006.01) |
| ***A47B 37/04*** | (2006.01) |
| *E04H 15/50* | (2006.01) |

(52) U.S. Cl.

CPC ..... *E04H 15/02* (2013.01); *A47B 3/083* (2013.01); *A47B 37/04* (2013.01); *E04H 15/50* (2013.01)

(58) Field of Classification Search

CPC .. A45B 2200/1063; A45B 3/00; A45B 23/00; A45B 37/04; A45B 2220/0008; A47B 37/04; A47B 2220/0008

USPC ..... 108/34, 35, 33, 38, 167, 115, 132, 131, 108/129, 128, 80, 81, 50.12, 169; 135/16

See application file for complete search history.

(56) References Cited

U.S. PATENT DOCUMENTS

| | | | | |
|---|---|---|---|---|
| 1,211,829 | A * | 1/1917 | Eades | 108/35 |
| 2,743,979 | A * | 5/1956 | Shore | 108/35 |
| 3,006,705 | A * | 10/1961 | Williams et al. | 108/14 |
| 3,176,699 | A * | 4/1965 | Rollins | 108/50.12 |
| 3,233,618 | A * | 2/1966 | Ferrier | A47B 37/04 108/42 |
| 4,596,484 | A * | 6/1986 | Nakatani | 403/104 |
| 4,744,690 | A * | 5/1988 | Hsieh | 403/104 |
| 6,802,265 | B1 * | 10/2004 | Dodson et al. | 108/50.12 |
| 6,866,054 | B1 * | 3/2005 | Collins | 108/50.12 |
| 6,908,249 | B2 * | 6/2005 | Tomm | 403/109.1 |
| 7,101,000 | B2 * | 9/2006 | DeMars | 108/50.12 |
| 7,195,377 | B2 * | 3/2007 | Tsai | 362/431 |

(Continued)

FOREIGN PATENT DOCUMENTS

| | | |
|---|---|---|
| CN | 2471879 Y | 1/2002 |
| CN | 2840787 Y | 11/2006 |

*Primary Examiner* — Jose V Chen

(74) *Attorney, Agent, or Firm* — Morgan, Lewis & Bockius LLP

(57) ABSTRACT

A folding bar table for removably supporting a canopy include a plurality of tabletop assemblies with each two adjacent tabletop assemblies rotatably connected to each other, a plurality of table leg assemblies for supporting the tabletop assemblies, and fastening components disposed at two ends of the rotatably connected tabletop assemblies for holding supporting poles of the canopy. A table leg assembly includes a standing pole and a movable pole, and one end of the movable pole is rotatably connected to the standing pole. For two adjacent tabletop assemblies, one tabletop assembly is rotatably connected to a corresponding standing pole, and the other tabletop assembly is rotatably connected to a corresponding movable pole. All rotational axes are substantially parallel to each other. The rotatably connected tabletop assemblies present a straight layout when unfolded.

15 Claims, 4 Drawing Sheets

(56) References Cited

U.S. PATENT DOCUMENTS 8,272,605 B2 * 9/2012 Fuchs ..... 248/166
8,608,118 B2 * 12/2013 Lai ..... 248/74.3
8,832,910 B2 * 9/2014 Lah ..... 24/457
2005/0126612 A1 * 6/2005 Chen ..... 135/16
2008/0105287 A1 * 5/2008 Huali et al. ..... 135/16
2013/0305965 A1 * 11/2013 Ramberg ..... 108/50.12

* cited by examiner

FOLDING BAR TABLE

CROSS-REFERENCE(S) TO RELATED APPLICATION

The present application claims priority to Chinese Patent Application Number 201420190335.X, filed Apr. 18, 2014, the entire contents of which is incorporated herein for all purposes by this reference.

FIELD OF THE INVENTION

The present invention relates to an outdoor leisure supply, and particularly, to a bar table with sunshade or a bar table for removably supporting a canopy.

DESCRIPTION OF RELATED ART

Currently, the sunshades are of a variety of structures, and commonly the sunshades have a foldable function which facilitates the portability; however, a majority of the sunshades are used for single purpose only, which provide the sun shading or rain sheltering environment for the customers. When leisure and entertainment activities are taken in this environment, items such as a bar table needs to be added, and normally it is inconvenient to carry these added items.

The PRC Utility Model No. ZL01217759.8 has disclosed a tent, in which two sets of shear-type pole support are provided on the bottom of columns, and a folding composite table is pivoted with the inner side of the two sets of shear type pole support through connecting seats, so that the tent has a foldable lying bed and chairs. However, the structure of this tent is quite complicated, the folding and unfolding operations of this tent are not easy, and moreover, the foldable lying bed and chairs cannot be detached from the tent when they are not required, which occupy a certain space and are not convenient in use.

The PRC Utility Model ZL200520084829.0 has disclosed a bar with a sun-shading awning, which includes a bar plate and a sun-shading awning, in which the bar plate is detachably fixedly connected between the two supporting legs of the sun-shading awning. However, the bar and the supporting frames are connected by a regular locking member, and the regular locking member always has the problems such as insufficient locking force or unreliable tightening. Furthermore, only a limiting device is arranged between the auxiliary supporting rod and a storage rack, and no linkage structure is arranged, so the folding becomes more complicated as more auxiliary supporting rods are used.

The information disclosed in this Background section is only for enhancement of understanding of the general background of the invention and should not be taken as an acknowledgement or any form of suggestion that this information forms the prior art already known to a person skilled in the art.

SUMMARY OF THE INVENTION

An objective of the present invention is directed to provide a bar table with sunshade or a bar table for removably supporting a canopy featured in a simple structure and easy to use.

To achieve the above and/or other objectives, a technical solution of the present invention is described as follows.

A bar table with sunshade or a bar table for removably supporting a canopy includes tabletop assemblies and table leg assemblies for supporting the tabletop assemblies, wherein two or more tabletop assemblies are arranged, two adjacent tabletop assemblies are rotatably connected together by means of a movable connecting piece, and the rotatably connected tabletop assemblies present a straight layout after being unfolded, and fastening components matched with the sunshade support poles are respectively arranged at the two ends of the two adjacent tabletop assemblies; the respective table leg assembly includes a standing pole and a movable pole of which one end is rotatably connected to the standing pole, one of each two adjacent tabletop assemblies is rotatably connected to the standing pole, while the other tabletop assembly is rotatably connected to the movable pole; parallel rotation shafts are arranged at all rotatable connection joints, and the rotation shafts are parallel to one another.

By adopting the above technical solution, since the movable pole has the limiting and linkage functions, when the bar table is unfolded and installed on the sunshade support poles, the movable pole provides a limiting function to the standing poles of the table leg assemblies, so that the table leg assemblies support the tabletop assemblies in a more stable manner, when the bar table needs to be folded, the movable pole can provide a linkage function, and when the tabletop assemblies are folded, the table leg assemblies are driven to be folded, which is a simple structure and is easy to use.

As an improvement to the present invention, the fastening component includes a fixed seat fixedly connected to the tabletop assemblies and a sliding seat slidably connected to the tabletop assemblies, a bolt is hinged to the sliding seat and a lock nut is arranged on the bolt, an opening slot is arranged on the fixed seat for receiving the bolt, and a rod insertion space is formed between the fixed seat and the sliding seat for accommodating the sunshade support poles. The fastening components of the above structure can realize a quick installation and disassembling of the bar table and the sunshade and meanwhile guarantees that the fastening components have a good locking force.

As an improvement to the present invention, the fastening component includes a fixed seat fixedly connected to the tabletop assemblies and a sliding seat slidably connected to the tabletop assemblies, a bolt is hinged to the fixed seat and the bolt has one end distal from the fixed seat being connected with an eccentric cam, the bolt is in transmission connection with the eccentric cam and its rotation shaft is located on an eccentric axis of the eccentric cam, an opening slot is arranged on the sliding seat for receiving the bolt, and a rod insertion space is formed between the fixed seat and the sliding seat for accommodating the sunshade support poles. This is another fastening component structure, and the above fastening component structure can further simplify the installation and detachment process of the bar table and the sunshade and is more convenient to use.

As an improvement to the present invention, an elongated slot is arranged on the tabletop assemblies at the position where the sliding seat are slidably connected to the tabletop assemblies for the sliding seat to slide, and the sliding seat is installed on the elongated slot by screws and nails. The elongated slot realizes the sliding function of the sliding seat, which is a simple structure. Furthermore, since the sliding seat is slidably connected to the tabletop assemblies, the size of the rod insertion space can be adjusted according to the real size of the sunshade support poles, which is more practicable.

The methods and apparatuses of the present invention have other features and advantages which will be apparent from or are set forth in more detail in the accompanying drawings, which are incorporated herein, and the following Detailed Description, which together serve to explain certain principles of the present invention.

REFERENCE OF A LIST OF NUMERALS IN THE FIGURES

1—tabletop assembly; 11—elongated slot;
2—table leg assembly; 21—standing pole;
22—movable pole; 3—connecting piece;
4—sunshade support poles; 5—fastening component;
51—fixed seat; 52—sliding seat;
53—bolt; 54—lock nut;
55—opening slot; 56—rod insertion space;
57—eccentric cam; 58—handle;
59—engagement slot.

DESCRIPTION OF THE EMBODIMENTS

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As used herein, a bar table, a folding bar table, a bar table with sunshade, a bar table for removably supporting a canopy and a folding bar table for removably supporting a canopy are interchangeable.

Figure 1:
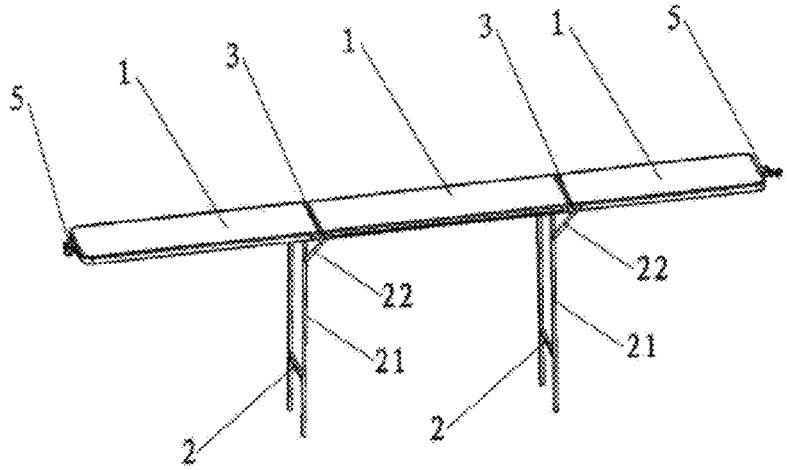
FIG. 1 is a schematic structural view of a bar table with sunshade of the present invention.
Figure 2:
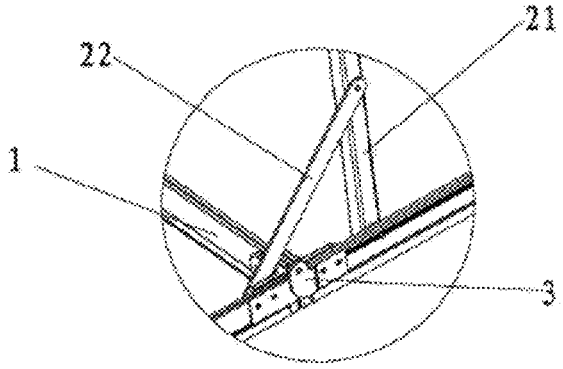
FIG. 2 is a schematic view of a connection structure of the movable pole according to the bar table with sunshade of the present invention.

Referring to FIG. 1, a bar table with sunshade according to the first embodiment of the present invention is illustrated, which includes a plurality of tabletop assemblies 1 and a plurality of table leg assemblies 2 for supporting the tabletop assemblies 1. The number of the tabletop assemblies 1 is arranged according to the requirement, and generally is two or more, and the structure of the tabletop assemblies may be a conventional table structure, such as only one table plate, and in this embodiment, three tabletop assemblies 1 are arranged, which is mainly formed by a variety of rods and has a table cloth or a table plate laid on top. Two adjacent tabletop assemblies 1 are rotatably connected together by means of a movable connecting piece 3, the rotatably connected tabletop assemblies 1 present a straight layout after being unfolded, fastening components 5 matched with the sunshade support poles 4 are respectively arranged at the two ends of the two adjacent tabletop assemblies, i.e. two fastening components 5 are arranged. The respective table leg assembly 2 includes a standing pole 21 and a movable pole 22 of which one end is rotatably connected to the standing pole 21, as shown in FIG. 2, one of each two adjacent tabletop assemblies 1 is rotatably connected to the standing pole 21, while the other tabletop assembly 1 is rotatably connected to the movable pole 22. Rotation shafts or axes are arranged at all rotatable connection joints, and the rotation shafts or axes are parallel to one another; in other words, the rotation shaft or axis about which the two adjacent tabletop assemblies 1 are rotatably connected, the rotation shaft or axis about which the standing pole 21 and the movable pole 22 are rotatably connected, the rotation shaft or axis about which the tabletop assemblies 1 and the standing pole 21 are rotatably connected, and the rotation shaft or axis about which the tabletop assemblies 1 and the movable pole 22 are rotatably connected are parallel to one another.

Figure 3:
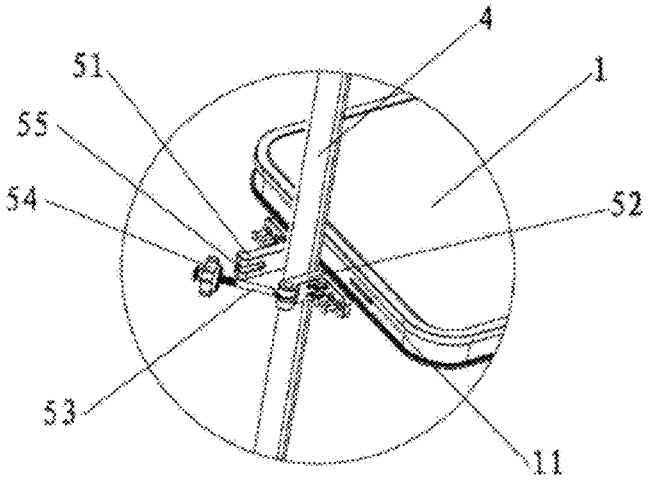
FIG. 3 is an exploded schematic structural view of the fastening component according to the first embodiment of the bar table with sunshade of the present invention.
Figure 4:
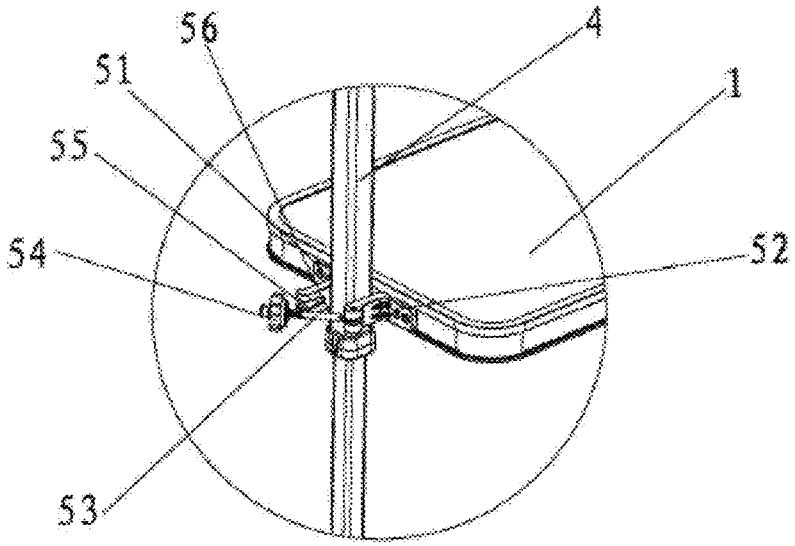
FIG. 4 is a schematic structural view of the fastening component in a loosen state according to the first embodiment of the bar table with sunshade of the present invention.
Figure 5:
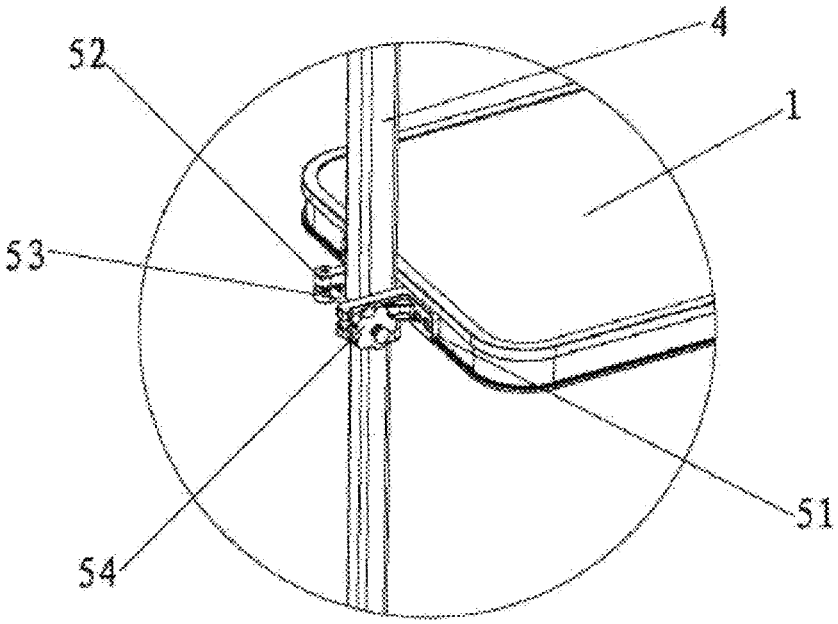
FIG. 5 is a schematic structural view of the fastening component in a tighten state according to the first embodiment of the bar table with sunshade of the present invention.

Referring to FIG. 3 to FIG. 5, the fastening component 5 of this embodiment is illustrated, which includes a fixed seat 51 and a sliding seat 52, which are arranged on two end surfaces along the length direction of the rotatably connected tabletop assemblies 1, and the fixed seat 51 and the sliding seat 52 may be connected to the tabletop assemblies 1 in a conventional manner or in another innovated connection method. In this embodiment, the fixed seat 51 is directly locked on one end surface along the length direction of the rotatably connected tabletop assemblies 1 by means of screws, and in the meantime, an elongated slot 11 is opened on the other end surface of the tabletop assemblies 1, the elongated slot 11 is spaced from the fixed seat 51 for a certain distance, the length direction of the elongated slot 11 is arranged along the width direction of the tabletop assemblies 1, and the sliding seat 52 is slidably connected on the elongated slot 11 by means of the screws or nails. A bolt 53 is hinged to the sliding seat 52, in which one end of the bolt 53 is hinged to the sliding seat 52 and the other end is dangling, a lock nut 54 is arranged on the bolt 53, an opening slot 55 is arranged on the fixed seat 51 for receiving the bolt, and a rod insertion space 56 is formed between the fixed seat 51 and the sliding seat 52 for accommodating the sunshade support poles 4.

Figure 6:
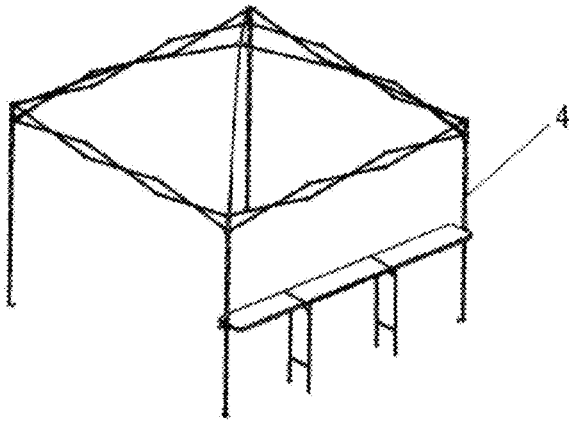
FIG. 6 is a schematic view illustrating a using status of the bar table with sunshade of the present invention when installed on the sunshade.

It should be explained herein that the sunshade in this embodiment used in the bar table with sunshade at least requires two sunshade support poles 4. In the process of installation, the bar table with sunshade is unfolded, and at the same time, the sliding seat 52 is moved to a maximal distance from the fixed seat 51, the lock nut 54 is rotated to be located at a tail end of the dangling end of the bolt 53, then two sunshade support poles 4 are selected and respectively put into the rod insertion space 56 of the fastening component 5, as shown in FIG. 4. At this moment, the fastening component 5 is still in a loosen state, next the sliding seat 52 is moved to tightly lean against the sunshade support poles 4, and the bolt 53 is inserted in the opening slot 55 at the same time, and at last, the lock nut 54 is tightened, so that the fixed seat 51 and the sliding seat 52 securely clamp the sunshade support poles 4 in the rod insertion space 56. The locking state is illustrated in FIG. 5, and to clearly show the locking state of the fastening component 5, the positions of the sliding seat 52 and the fixed seat 51 are opposite in FIG. 5. The status of the whole bar table with sunshade after being installed on the sunshade is illustrated in FIG. 6.

Figure 7:
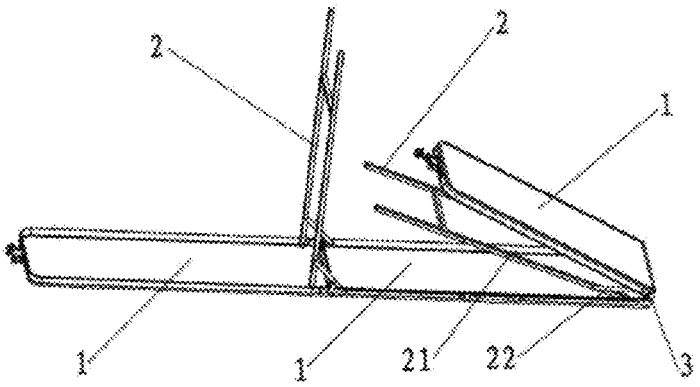
FIG. 7 is a schematic view illustrating a process of folding the bar table with sunshade of the present invention.
Figure 8:
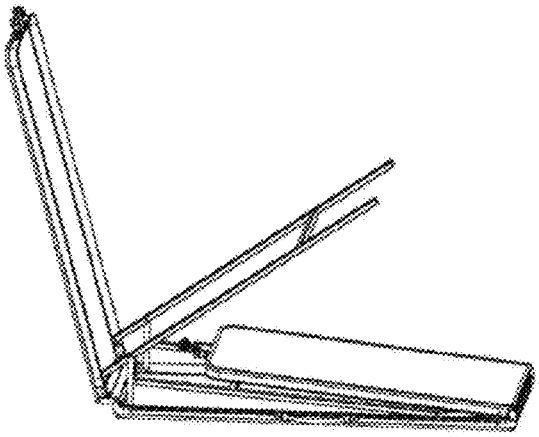
FIG. 8 is a schematic view illustrating a further step of folding the bar table with sunshade of the present invention.
Figure 9:
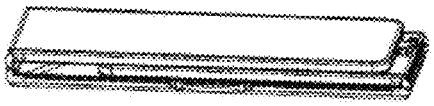
FIG. 9 is a schematic view illustrating a completely folded bar table with sunshade of the present invention.

To perform folding, firstly the lock nut 54 is loosened, the bolt 53 is removed from the opening slot 55, and then the sliding seat 52 is moved to depart from the sunshade support poles 4, so that the sunshade support poles 4 are removed from the rod insertion space 56. Thereafter, the bar table with sunshade is inverted, and the tabletop assembly 1 on one side is folded in a direction towards the middle tabletop assembly 1 along the connecting piece 3, and at this moment, the corresponding table leg assembly 2 is driven by the movable pole 22 to move along with the tabletop assembly 1 and is folded in a direction towards the middle tabletop assembly 1, as shown in FIG. 7. On the same principle, the tabletop assembly 1 on the other side is folded in the direction towards the middle tabletop assembly 1 along the other connecting piece 3, as shown in FIG. 8, and at last, the folding of the bar table with sunshade is completed, as shown in FIG. 9.

Figure 10:
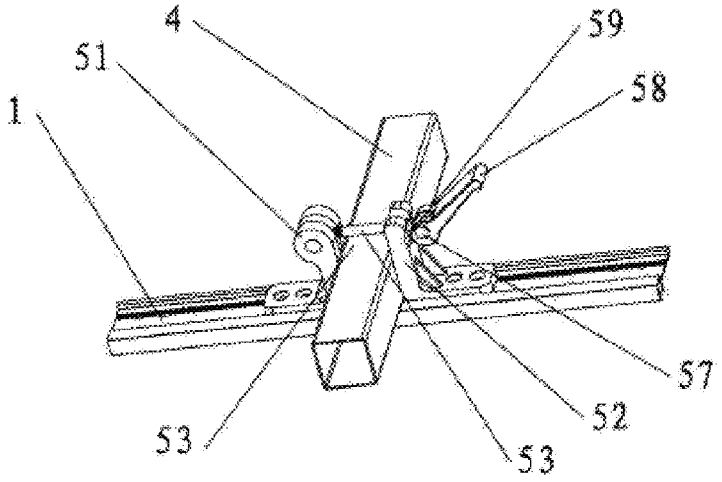
FIG. 10 is a schematic structural view of the fastening component according to the second embodiment of the bar table with sunshade of the present invention.

The present invention has a second embodiment, which is different from the first embodiment in terms of the structure of the fastening component 5. FIG. 10 illustrates the structure of the fastening component 5 according to this embodiment, and similarly, the fastening component 5 includes a fixed seat 51 arranged on two end surfaces along the length direction of the rotatably connected tabletop assemblies 1 and a sliding seat 52 slidably connected to the two end surfaces along the length direction of the rotatably connected tabletop assemblies 1, in which the sliding seat 52 may be slidably connected to the tabletop assemblies 1 in a same manner of the first embodiment or in another manner, and the fixed seat 51 is spaced from the sliding seat 52 for a distance. A bolt 53 is hinged to the fixed seat 51, in which one end of the bolt 53 is hinged to the fixed seat 51 and the other end that is distal from the fixed seat 51 is in transmission connection to the eccentric cam 57, the rotation shaft about which the bolt 53 and the eccentric cam 57 are transmissively connected is located on the eccentric axis of the eccentric cam 57, and the extent of eccentricity of the eccentric cam 57 can be designed according to practical requirements. For the convenience in use, the eccentric cam 57 is provided with a handle 58 for rotating the eccentric cam, and the sliding seat 52 is provided with an opening slot 55 for receiving the bolt 53 and an engagement slot 59 matched with the eccentric cam. It is comprehensive to those skilled in the art with reference to the embodiments in combination with the prior arts that the function of the engagement slot 59 aims to further secure the position of the eccentric cam 57, and the technical solution of this embodiment can be accomplished in the absence of this feature. A rod insertion space 56 is formed between the fixed seat 51 and the sliding seat 52, for accommodating the sunshade support poles 4.

Figure 11:
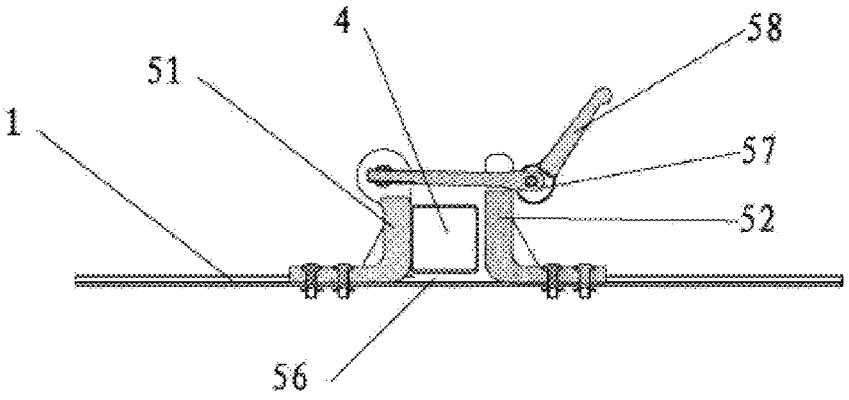
FIG. 11 is a schematic structural view of the fastening component in a loosen state according to the second embodiment of the bar table with sunshade of the present invention.
Figure 12:
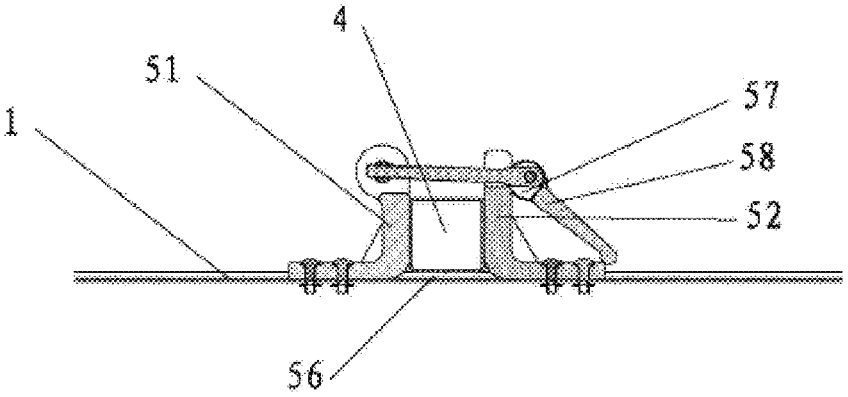
FIG. 12 is a schematic structural view of the fastening component in a tighten state according to the second embodiment of the bar table with sunshade of the present invention.

The installation process of the fastening component 5 according to the present invention is substantially the same as that in the first embodiment, and the difference lies in that: in this embodiment, before the bolt 53 of the fastening component 5 is inserted in the opening slot 55, the handle 58 needs to be moved upwards, and then the bolt 53 is inserted in the opening slot 55, so that the eccentric cam 57 is engaged in the engagement slot 59. At this moment, the distance from the contact position of the eccentric cam 57 and the engagement slot 59 to the eccentric axis of the eccentric cam 57 is the shortest distance, where the current status is illustrated in FIG. 11. Then, the handle 58 is pressed downwardly to drive the eccentric cam 57 to rotate, so that the distance from the contact position of the eccentric cam 57 and the engagement slot 59 to the eccentric axis of the eccentric cam 57 is increased, thereby driving the sliding seat 52 by means of the bolt 53 to move towards the fixed seat 51, so as to clamp the sunshade support poles 4 in the rod insertion space 56, where the clamped status is illustrated in FIG. 12. To disassemble, just repeat the above steps in a reverse order. When the fastening component 5 of this embodiment is adopted, the locking force relies on the extent of eccentricity of the eccentric cam.

The present invention has been illustrated in details in the above paragraphs with reference to embodiments in accompanying with drawings. However, it should be noted that the implementation of the present invention is not limited to the above embodiments, and all sorts of variations and modifications can be made to the present invention by those skilled in the art, for example a slide rail structure may be arranged on the tabletop assemblies 1 instead of the elongated slot 11 as mentioned in the above embodiments, and these variations and modifications fall within the protection scope of the present present invention.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A bar table for removably supporting a canopy, wherein the canopy includes supporting poles, the bar table comprising tabletop assemblies and table leg assemblies for supporting the tabletop assemblies, characterized in that the number of the tabletop assemblies is two or more, wherein two adjacent tabletop assemblies are rotatably connected together by a movable connecting piece, the rotatably connected tabletop assemblies present a straight layout after being unfolded, and fastening components having a loosen state for receiving the support poles of the canopy and a locking state for fastening the support poles of the canopy are respectively arranged at two ends of the tabletop assemblies; each respective table leg assembly includes a standing pole and a movable pole of which one end is rotatably connected to the standing pole, one of each two adjacent tabletop assemblies is rotatably connected to the standing pole, while the other tabletop assembly is rotatably connected to the movable pole; rotation shafts are arranged at all rotatable connection joints, and the rotation shafts are parallel to one another; and the fastening component comprises a fixed seat fixedly connected to the tabletop assemblies and a sliding seat slidably connected to the tabletop assemblies, a bolt is hinged to the sliding seat and a lock nut is arranged on the bolt, an opening slot is arranged on the fixed seat for receiving the bolt, and a rod insertion space is formed between the fixed seat and the sliding seat for accommodating the support poles of the canopy.

2. The bar table according to claim 1, characterized in that an elongated slot is formed on the tabletop assemblies at a position where the sliding seat is slidably connected to the tabletop assemblies for the sliding seat to slide along an width direction of the tabletop assemblies, and the sliding seat is installed on the elongated slot by screws and nails.

3. The bar table according to claim 1, characterized in that an elongated slot is formed on the tabletop assemblies at a position where the sliding seat is slidably connected to the tabletop assemblies for the sliding seat to slide, and the sliding seat is installed on the elongated slot by screws and nails.

4. The folding bar table of claim 1, wherein the fixed seat is fixedly mounted on an end surface of the tabletop assemblies along a length direction of the tabletop assemblies, and the sliding seat is slidably mounted on the end surface of the tabletop assemblies, wherein the sliding seat is slidable along a width direction of the tabletop assemblies.

5. A bar table for removably supporting a canopy, wherein the canopy includes supporting poles, the bar table comprising tabletop assemblies and table leg assemblies for supporting the tabletop assemblies, characterized in that the number of the tabletop assemblies is two or more, wherein two adjacent tabletop assemblies are rotatably connected together by a movable connecting piece, the rotatably connected tabletop assemblies present a straight layout after being unfolded, and fastening components having a loosen state for receiving the support poles of the canopy and a locking state for fastening the support poles of the canopy are respectively arranged at two ends of the tabletop assemblies; each respective table leg assembly includes a standing pole and a movable pole of which one end is rotatably connected to the standing pole, one of each two adjacent tabletop assemblies is rotatably connected to the standing pole, while the other tabletop assembly is rotatably connected to the movable pole; rotation shafts are arranged at all rotatable connection joints, and the rotation shafts are parallel to one another; and the fastening component comprises a fixed seat fixedly connected to the tabletop assemblies and a sliding seat slidably connected to the tabletop assemblies, a bolt is hinged to the fixed seat and of which one end distal from the fixed seat is connected with an eccentric cam, such that the bolt is rotatable around an eccentric axis of the eccentric cam, an opening slot is formed on the sliding seat for receiving the bolt, and a rod insertion space is formed between the fixed seat and the sliding seat for accommodating the sunshade support poles.

6. The bar table according to claim 5, characterized in that an elongated slot is formed on the tabletop assemblies at a position where the sliding seat is slidably connected to the tabletop assemblies for the sliding seat to slide along an width direction of the tabletop assemblies, and the sliding seat is installed on the elongated slot by screws and nails.

7. The bar table according to claim 5, characterized in that an elongated slot is formed on the tabletop assemblies at a position where the sliding seat is slidably connected to the tabletop assemblies for the sliding seat to slide, and the sliding seat is installed on the elongated slot by screws and nails.

8. The folding bar table of claim 5, wherein the fixed seat is fixedly mounted on an end surface of the tabletop assemblies along a length direction of the tabletop assemblies, and the sliding seat is slidably mounted on the end surface of the tabletop assemblies, wherein the sliding seat is slidable along a width direction of the tabletop assemblies.

9. A folding bar table for removably supporting a canopy, wherein the canopy includes a plurality of supporting poles, the folding bar table comprising:

(i) a plurality of tabletop assemblies, wherein each two adjacent tabletop assemblies are rotatably connected to each other by a connecting piece such that the rotatably connected tabletop assemblies present a straight layout when unfolded;

(ii) a plurality of table leg assemblies for supporting the tabletop assemblies, wherein each table leg assembly includes a standing pole and a movable pole, and one end of the movable pole is rotatably connected to the standing pole; and (iii) fastening components disposed at two ends of the rotatably connected tabletop assemblies, the fastening components having a loosen state for receiving the support poles of the canopy and a locking state for fastening the support poles of the canopy, wherein for each two adjacent tabletop assemblies, one tabletop assembly is rotatably connected to a corresponding standing pole, and the other tabletop assembly is rotatably connected to a corresponding movable pole, wherein all rotational axes are substantially parallel to each other, and wherein a fastening component in the fastening components comprises:

a fixed seat fixedly connected to the tabletop assemblies;

a sliding seat slidably connected to the tabletop assemblies;

a bolt hinged to the sliding seat;

a lock nut arranged the bolt;

an opening slot formed on the fixed seat for receiving the bolt; and a rod insertion space formed between the fixed seat and the sliding seat for accommodating a corresponding supporting pole of the canopy.

10. The folding bar table of claim 9, wherein an elongated slot is formed on the corresponding tabletop assembly at a position in accord with the sliding seat, and the sliding seat is slidably installed on the elongated slot by screws and nails.

11. The folding bar table of claim 9, wherein the fixed seat is fixedly mounted on an end surface of the tabletop assemblies along a length direction of the tabletop assemblies, and the sliding seat is slidably mounted on the end surface of the tabletop assemblies, wherein the sliding seat is slidable along a width direction of the tabletop assemblies.

12. The folding bar table of claim 9, wherein one end of the bolt is hinged to the sliding seat and the lock nut is arranged on the other end of the bolt.

13. A folding bar table for removably supporting a canopy, wherein the canopy includes a plurality of supporting poles, the folding bar table comprising:

(i) a plurality of tabletop assemblies, wherein each two adjacent tabletop assemblies are rotatably connected to each other by a connecting piece such that the rotatably connected tabletop assemblies present a straight layout when unfolded;

(ii) a plurality of table leg assemblies for supporting the tabletop assemblies, wherein each table leg assembly includes a standing pole and a movable pole, and one end of the movable pole is rotatably connected to the standing pole; and (iii) fastening components disposed at two ends of the rotatably connected tabletop assemblies, the fastening components having a loosen state for receiving the support poles of the canopy and a locking state for fastening the support poles of the canopy, wherein for each two adjacent tabletop assemblies, one tabletop assembly is rotatably connected to a corresponding standing pole, and the other tabletop assembly is rotatably connected to a corresponding movable pole, wherein all rotational axes are substantially parallel to each other, and wherein a fastening component in the fastening components comprises:

a fixed seat fixedly connected to the tabletop assemblies along a length direction of the tabletop assemblies;

a sliding seat slidably connected to the tabletop assemblies;

a bolt hinged to the fixed seat, wherein one end of the bolt distal from the fixed seat is connected with an eccentric cam, such that the bolt is rotatable around an eccentric axis of the eccentric cam;

an opening slot formed on the sliding seat for receiving the bolt; and a rod insertion space formed between the fixed seat and the sliding seat for accommodating a corresponding supporting pole of the canopy.

14. The folding bar table of claim 13, wherein an elongated slot is formed on the corresponding tabletop assembly at a position in accord with the sliding seat, and the sliding seat is slidably installed on the elongated slot by screws and nails.

15. The folding bar table of claim 13, wherein the fixed seat is fixedly mounted on an end surface of the tabletop assemblies along a length direction of the tabletop assemblies, and the sliding seat is slidably mounted on the end surface of the tabletop assemblies, wherein the sliding seat is slidable along a width direction of the tabletop assemblies.

* * * * *